US005706836A

United States Patent [19]

McKeown

[11] Patent Number: 5,706,836

[45] Date of Patent: Jan. 13, 1998

[54] HAIR ORNAMENT AND HAIR CONTROL DEVICE SECURING ASSEMBLY

[76] Inventor: Kathleen McKeown, R.R. 1 Box 211 K, Perryopolis, Pa. 15473

[21] Appl. No.: 399,564

[22] Filed: Mar. 7, 1995

[51] Int. Cl.[6] ..... A45D 24/38

[52] U.S. Cl. ..... 132/144; 132/273; 132/278; 132/275; 132/141

[58] Field of Search ..... 132/144, 273, 132/275, 278, 279, 162, 141; 2/918, 209.11, 209.13, DIG. 11

[56] References Cited

U.S. PATENT DOCUMENTS

| | | | |
|---|---|---|---|
| 1,638,756 | 8/1927 | Wallman . | |
| 2,312,813 | 3/1943 | Goldstein | 132/65 |
| 2,510,554 | 6/1950 | Christie | 132/11 |
| 3,385,305 | 5/1968 | Buzzeli | 132/105 |
| 3,467,111 | 9/1969 | Benson | 132/46 |
| 3,542,041 | 11/1970 | Mercorella | 132/273 |
| 3,669,129 | 6/1972 | Serebrin | 132/273 |
| 3,776,244 | 12/1973 | Morgan | 132/273 |
| 4,630,317 | 12/1986 | Brown et al. | 2/DIG. 11 |
| 4,753,252 | 6/1988 | Boxer | 132/279 |
| 4,852,189 | 8/1989 | Duggan | 2/452 |
| 4,993,079 | 2/1991 | Johnson | 2/DIG. 11 |
| 5,170,509 | 12/1992 | Leopold | 132/273 |
| 5,293,884 | 3/1994 | Chapman et al. | 132/273 |
| 5,427,123 | 6/1995 | Odenthal | 132/275 |

FOREIGN PATENT DOCUMENTS

| | | | |
|---|---|---|---|
| 240702 | 10/1925 | United Kingdom | 132/141 |

*Primary Examiner*—Cary E. O'Connor
*Assistant Examiner*—Pedro Philogene

[57] ABSTRACT

Securing assembly for attaching hair ornaments, hair control devices, and other items to the hair securely and comfortably, in the position on the head the wearer deems flattering. Variably sized mechanisms for holding specific amounts of hair in specific positions on the head (FIGS. 4-A through 4-C), securely attach to the head various hair ornaments, hair control devices, and other items (FIGS. 1-A, 2-A, 3-A, and FIGS. 5 through 12) by the mating of strips of hook-and-loop fastener affixed, respectively, to their top surface and under surface (FIGS. 1-C, 2-C, and 3-C).

6 Claims, 6 Drawing Sheets

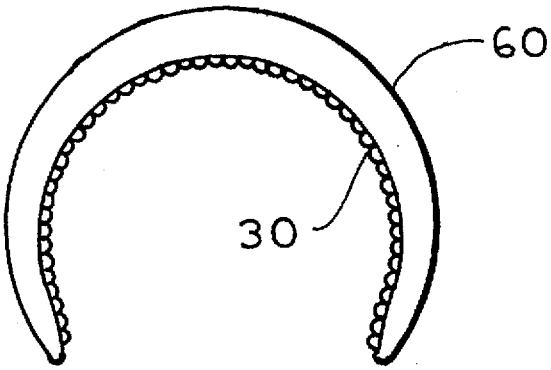
FIG. 1-A
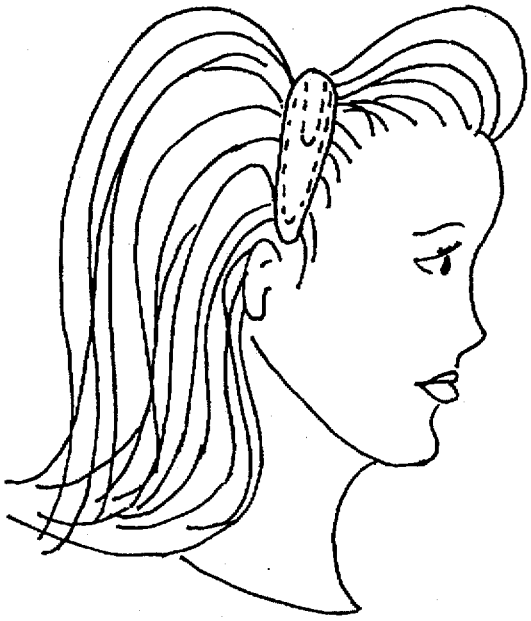
FIG. 1-C
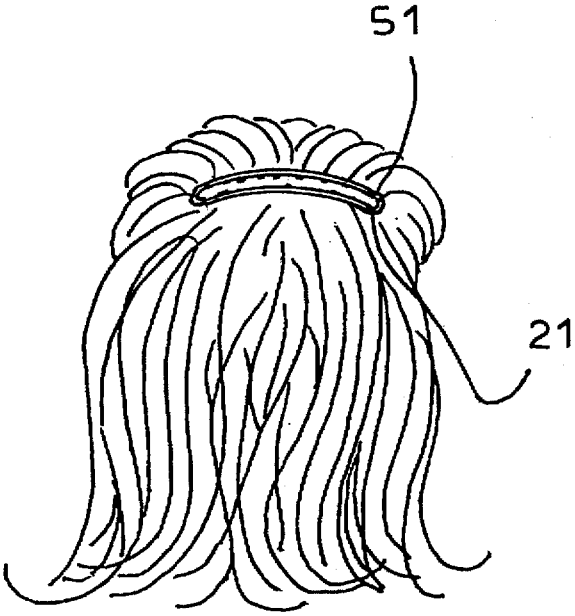
FIG. 1-B

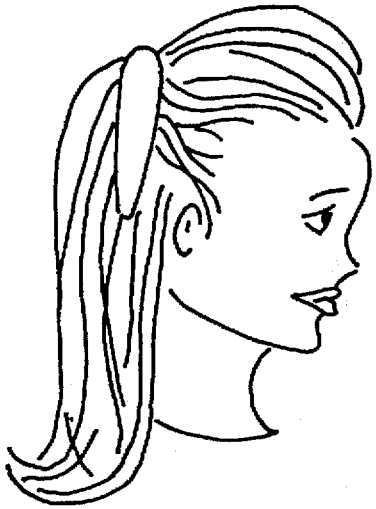
FIG. 1-D
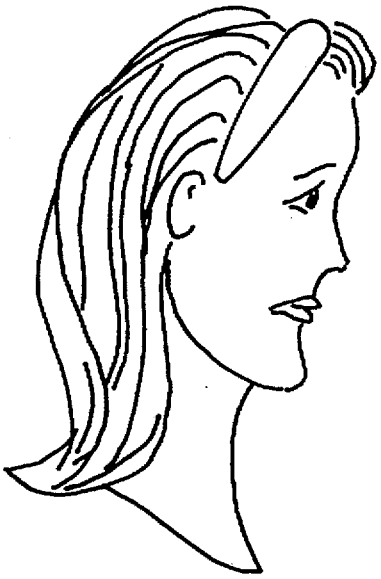
FIG. 1-E

FIG. 2-A
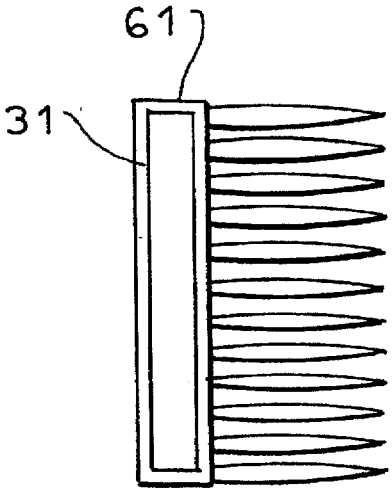
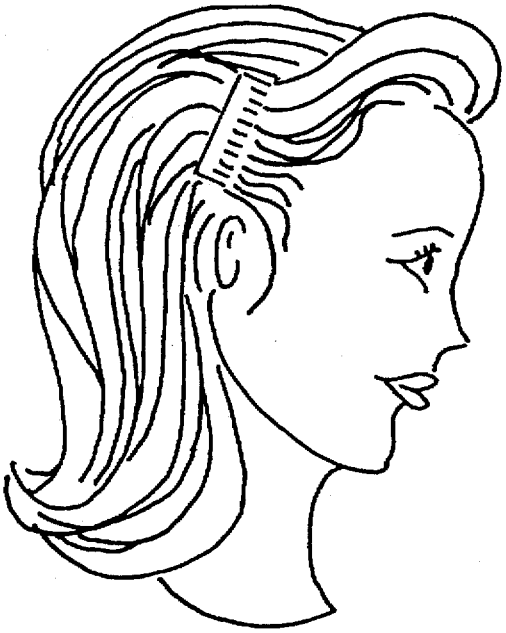
FIG. 2-C
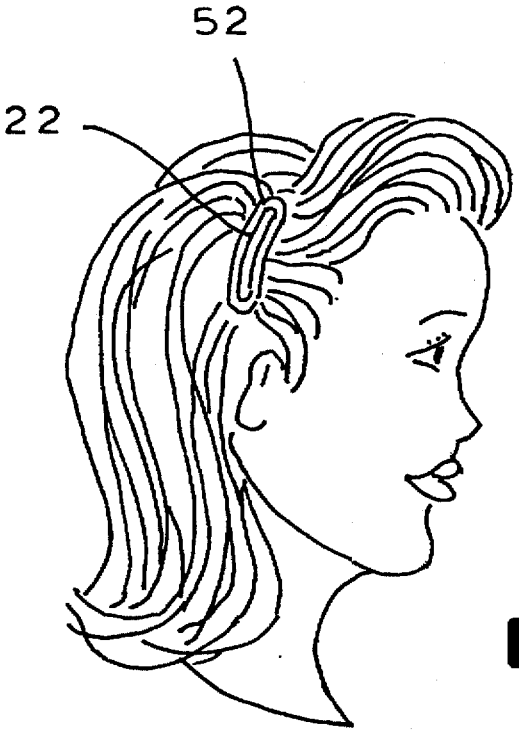
FIG. 2-B

FIG. 3-A
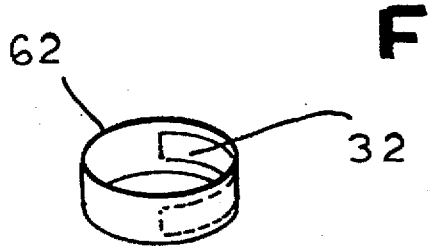
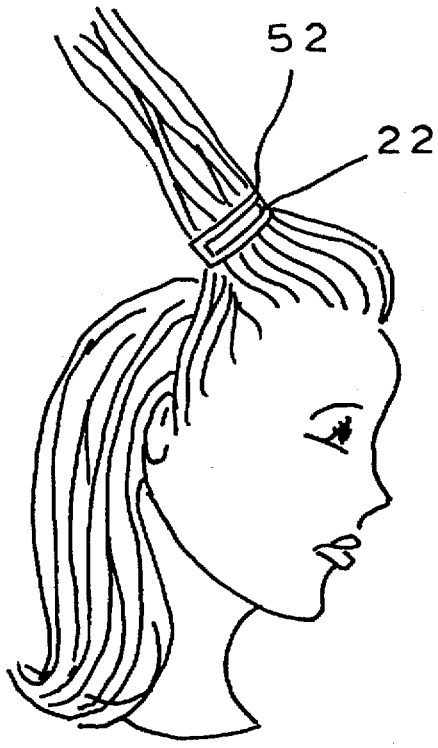
FIG. 3-B
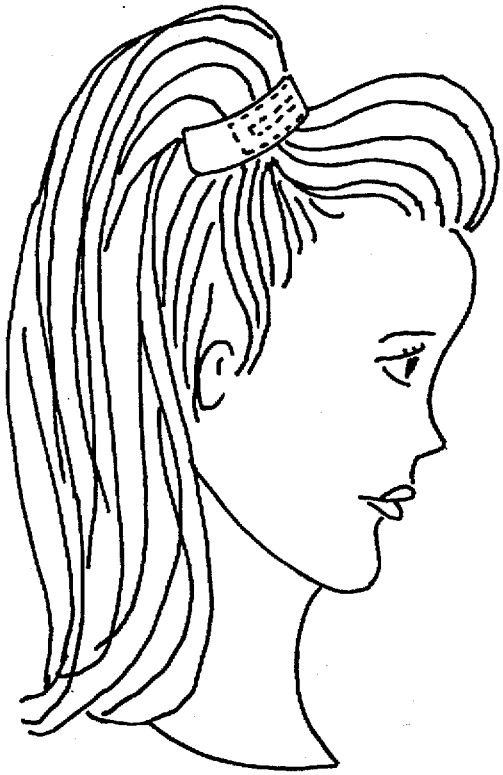
FIG. 3-C

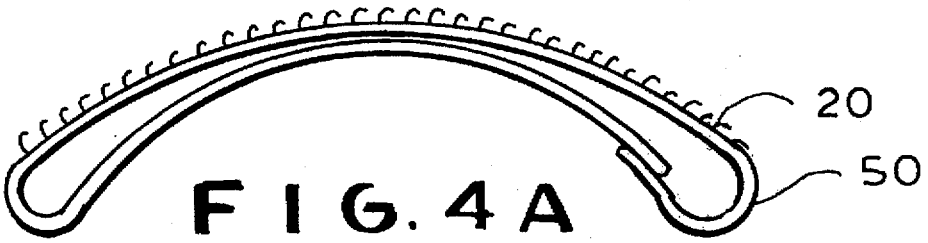
FIG. 4A
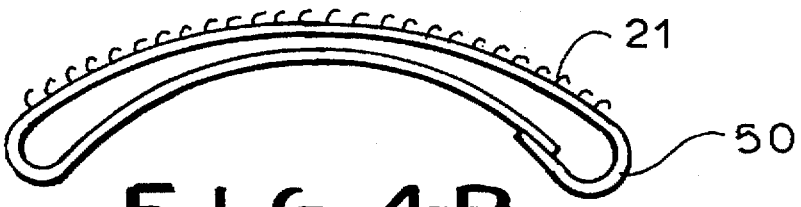
FIG. 4-B
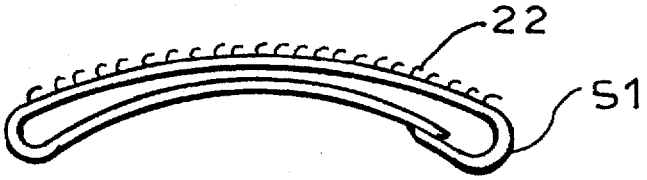
FIG. 4-C
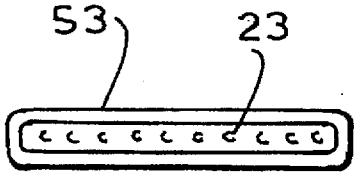
FIG. 4-D
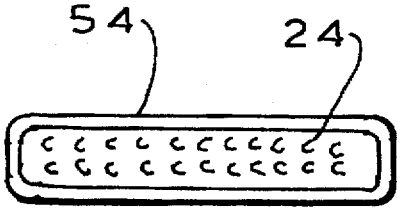
FIG. 4-E

HAIR ORNAMENT AND HAIR CONTROL DEVICE SECURING ASSEMBLY

BACKGROUND—FIELD OF INVENTION

This invention relates to hair ornaments and hair control devices, specifically to a variably sized mechanism whereby said hair ornaments and hair control devices can be rendered more secure in the hair, more comfortable, more versatile, more economical, and more flattering.

BACKGROUND—DESCRIPTION OF PRIOR ART

Hair ornaments and hair control devices are frequently very uncomfortable. For example, headbands either squeeze the wearer's head, or they are so loose they slide forward requiring frequent adjusting, or they simply fall off.

Likewise, combs that hold hair in place often fall out, or must be pushed in so tightly that they hurt. Moreover, many hair ornaments and hair control devices are not usable by many women because of the volume and length of hair required for their use. Combs, for example, slither out of thin, silky hair with remarkable speed.

Also, the placement on the head of the hair ornament or hair control device is often dictated more by the configuration of the hair ornament or hair control device than it is by the wearer's preference for its location. Headbands, for instance, have always gravitated to the smallest part of the head, and so the wearer could not use placement of the headband to flatter face shape: close to front of face to give the appearance of ovalness to a long thin face; at the back of the head to give the appearance of length to a round or plump face.

Furthermore, wearers who wish to create curves or waves, or height, or "poofs" in the hair, often must resort to the use of hair sprays or mousses or gels on the hair, or to "back-combing" or "teasing" the hair to achieve height or graceful curves.

Prior art discloses one attempt to remedy the problem of headbands slipping and being uncomfortable. U.S. Pat. No. 3,467,111, issued to Benson in 1969, shows a headband, to the underside of which is applied a piece of material, having resilient hooks protruding outwardly, so as to engage the wearer's hair and hold the band in place. I have never seen this invention in commercial use; however, there is a similar device commonly used in headbands on the market, in which hard plastic teeth line the underside of the headband to engage the hair.

This does help somewhat with slippage, but still the headband must squeeze the head. And if the teeth press into the head, as they often do, these headbands with teeth can be even more uncomfortable than standard headbands.

Moreover, these teeth, and/or the hooks described by Benson, do not allow the wearer to create curves and height, or "poofs" in the hair. And they do not insure that the headband stays in place if the head moves vigorously, if, for example, the wearer dances, exercises, or plays sports.

A patent for a headband adjusting device, U.S. Pat. No. 1,638,756, was issued to Wallman in 1927. Wallman discloses a head dress in the form of two encircling bands which connect, and can be adjusted, by means of a key. Further, small combs, which engage the hair on the sides of the head, help to hold the head dress in place. Combs, themselves, don't hold particularly well, as stated above, although as an adjust to the double bands, they should be useful. Further, "multiplex keyhole slots" in the bands allow ornaments to be attached. This device is designed to hold hair in the style favored by "flappers"in the 1920's. While, because it is adjustable, it probably is not uncomfortable, the configuration of the device cannot be used with the headbands worn today. Moreover, this device presses hair against the forehead, and rests just above the eyebrows, a style which is not popular today. Finally, this device is designed to stay in one spot on the hair, and does not allow the wearer to position the headband in many places on the head, thus flattering face shape.

There are three instances in prior art of combs being used to attach other items to the hair.

Buzzelli, U.S. Pat. No. 3,385,305, issued in 1968, discloses a detachable coiffure comprising a pad which is held to the wearer's head by a comb, and which has the hook side of a hook-and-loop fastener on its upper surface. A plurality of wiglets, each being attached to pads with the loop side of a hook-and-fastener on their under-surface, can be attached to the pad on the head. Further, the pad on the head can be dome-shaped, and the wiglet draped over it to give height to the hairstyle. This device applies only to wiglets, not hair ornaments. More significantly, it relies on combs, which don't stay in the hair very well. Note that toupees, for example, sold today, will be held by special clips, or with double-sided tape, and not with combs. This device, does, however, speak to two desirable attributes of hair devices: the ability to get height in the hair, and the option to have versatility in hair ornamentation economically.

A device that uses a comb to hold a hat on is disclosed by Goldstein et al, U.S. Pat. No. 2,312,813, issued in 1943, and a device that uses combs to hold a scarf or hood on the head is disclosed by Christie, U.S. Pat. No. 2,510,554, issued in 1950. Both of these inventions speak to the need of women to keep things attached to the hair. They rely on combs to hold items in the hair, but, as stated above, combs themselves generally do not stay securely and comfortably in the hair.

Two devices disclosed in prior art involve headbands, to which other items are removably attached, via hook-and-loop fasteners. Duggan discloses, in U.S. Pat. No. 4,852,189, issued in 1989, a perspiration-absorbent headband to which frameless sunglasses can be applied with hook-and-loop fasteners. Since the headband is elastic, it should not cause discomfort, as other headbands do.

Johnson discloses, in U.S. Pat. No. 4,993,079, issued in 1991, an adjustable headband that rides across the forehead and around the back of the head, to which a hat can be attached. There are pieces of the loop side of a hook-and-loop fastener attached to the headband, and pieces of the hook side of a hook-and-loop fastener attached to the inner band of the hat. This means that the hat cannot be worn without the headband, because the hooks would scratch the forehead.

Again, both of these inventions address the need to securely and comfortably secure an item to the head. They both rely on an elastic or adjustable headband. They do not address the issue of making molded headbands and combs stay on the head comfortably and securely. Nor do they address the issue of a wearer being able to preate height in the hair, or to place a hair ornament or hair control device in a position on the head that is flattering to face shape. Also, they only address hats and sunglasses.

OBJECTS AND ADVANTAGES

Accordingly, several objects and advantages of my invention are:

a) it makes many hair ornaments and hair control devices more comfortable;

b) it makes hair ornaments and hair control devices stay in the hair exactly where the wearer wants them, without slippage or loss, and without pain or discomfort;

c) it makes all popular hair ornaments and hair control devices wearable by people with short hair or very fine or thin hair;

d) it allows people to wear many hair ornaments and hair control devices in a variety of positions on the head, and thereby makes the hair ornaments and hair control devices more versatile, and, sometimes, more economical, because a purchase of one ornament can allow a variety of "looks";

e) it allows hair ornaments and hair control devices to stay in place during strenuous activity such as exercise, sports, and dancing;

f) it allows other devices that are worn on the head in the manner of headbands, such as earmuffs, and headphones for radios, televisions, telephones, and tape recorders, to be worn comfortably, but yet be in no danger of slipping over the face or falling off during sports, exercise, dance and other vigorous activity;

g) it allows a wearer to arrange the hair in fancy curves or "poofs" and to have that hair held firmly, yet comfortably, in the desired shape, and the wearer can secure the desired hair ornament or hair control device without compromising or dragging down the curve or "poof" of the hair;

h) it allows a wearer to have "height" in the hair, giving the appearance of a longer, slimmer face, without the use of hairsprays, gels, or mousses, and without "teasing" or "backcombing" the hair;

i) it allows people who have physical disabilities, which make reaching the head difficult, to secure, or to have secured for them, a hair ornament or hair control device which will stay securely in place all day long;

j) it allows pre-teens and young teenagers, who have smaller heads, but grown-up tastes, to wear hair ornaments and hair control devices made for adult-size heads;

k) it allows a child to secure a hair ornament to a doll's head and have that ornament stay in place during play.

Further objects and advantages of my invention will become apparent from a consideration of the drawings and ensuing description.

SUMMARY

A hair control device and head worn article securing assembly which allows a wearer or user to place hair control device or head worn article in the position on the head he or she chooses, and the have that device or article be comfortable and secure, even during vigorous activity.

BRIEF DESCRIPTION OF THE DRAWING FIGURES

In the drawings, closely related figures have the same number but different alphabetic suffixes.

FIGS. 1-A through 1-E show the invention in one of its preferred embodiments: securing a molded headband to the head comfortably and securely, in the position the wearer chooses.

FIGS. 2-A through 2-C show a second preferred embodiment of the invention: securing a comb to the hair comfortably and securely.

FIGS. 3-A through 3-C show a third preferred embodiment of the invention: securing a hair cascade foundation to the hair in such a way that the hair is given height, comfortably and securely.

FIGS. 4-A through 4-E show various sizes of barrettes used in the invention to hold varying amounts of hair in the position on the head the wearer prefers.

DRAWING REFERENCE NUMERALS

Figure 5:
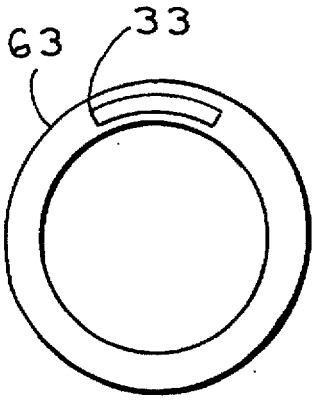
FIG. 5 shows an elastic material headband.

All drawings reference numerals in the 20's refer to variable-sized strips of the hook side of a hook-and-loop fastener.

All drawings reference numerals in the 30's refer to variably-sized strips of the loop side of a hook-and-loop fastener.

All drawings reference numerals in the 50's refer to variably-sized means for holding a specific amounts of hair in a specific position on a wearer's head.

All drawings reference numerals in the 60's and 70's refer to hair ornaments and hair control devices and other devices that can be secured to the head securely and comfortably by the use of this invention.

20. strip of hook side of hook-and-loop fastener affixed to large barrette

21. strip of hook side of hook-and-loop fastener affixed to medium barrette

22. strip of hook side of hook-and-loop fastener affixed to small barrette

23. strip of hook side of hook-and-loop fastener affixed to extra small barrette

24. strip of hook side of hook-and-loop fastener affixed to wider extra small barrette

30. strip of loop side of hook-and-loop fastener affixed to molded headband

31. strip of loop side of hook-and-loop fastener affixed to comb

32. strip of loop side of hook-and-loop fastener affixed to hair cascade foundation

33. strip of loop side of hook-and-loop fastener affixed to elastic headband

34. strip of loop side of hook-and-loop fastener affixed to partially elastic headband

35. strip of loop side of hook-and-loop fastener affixed to a comb for a French twist

36. strip of loop side of hook-and-loop fastener affixed to a tiara-band generic hair ornament

37. strip of loop side of hook-and-loop fastener affixed to earphones

38. strip of loop side of hook-and-loop fastener affixed to earmuffs.

39. strip of loop side of hook-and-loop fastener affixed to a pin-backed finding.

50. large barrette

51. medium barrette

52. small barrette

53. extra small barrette 54. wider extra small barrette
60. molded headband
61. comb
62. hair cascade foundation
63. elastic headband
64. partially elastic headband
65. comb for French twist
66. generic hair ornament
67. earphones
68. earmuffs
69. base of pin-backed finding
70. pin section of pin-backed finding
71. "scrunchie" hair ornament
72. circle of elastic inside "scrunchie" hair ornament

DESCRIPTION

A preferred embodiment of the hair ornament and hair control device securing assembly is illustrated in FIGS. 1-A through 1-E. These figures illustrate the securing assembly which allows a molded headband to be securely and comfortably secured to the head in the position the wearer chooses. 1-A shows molded plastic headband 60, to which is affixed a strip of the loop side of a hook-and-loop fastener 30. The headband 60 can be simply plastic, or it can be covered with various decorative materials such as cotton, silk, wood, linen, suede, leather, or man-made fabrics. It can also be padded with foam, and it can be decorated with gemstones, pearls, lacquered paper, beads, seashells and other decorative items suitable for wear in the hair. The plastic must be malleable, so that the wearer can stretch the band so that it fits comfortably without squeezing or pivoting the head. The strip of the loop side of a hook-and-loop fastener can be of any size that allows the hook-and-loop fastener to perform its fastening function. Experience shows that a length and width approximately 1 cm long by ¼ cm wide is the minimum size for secure fastening. However, a strip which lines the entire underside of the headband, of approximately 1 cm wide by 37 cm long, provides the most elegant appearance and the most options for the wearer. FIG. 1-B shows a barrette 51 holding a specific amount of hair in a specific position on the head, in a position the wearer has chosen. Affixed to barrette 51 is a strip of the hook side of a hook-and-loop fastener 21. The strip must be, at minimum, of a size that allows the hook-and-loop fastener to perform its fastening function. As above the minimum size is approximately 1 cm long by ¼ cm wide. However, a strip which covers most of the top surface of the barrette provides the most elegant appearance, and provides the most firm hold of the headband. While barrette 51, a medium-sized barrette, is shown here, barrettes of other sizes, as illustrated in FIGS. 4-A through 4-E, could also be used, depending on the length and thickness of the wearer's hair, and on where and how the wearer wishes to position the headband on the head. FIGS. 1-D and 1-E show the headband in different positions on the head.

A second preferred embodiment of the invention is illustrated in FIGS. 2-A through 2-C. These figures illustrate the securing assembly which allows a comb to be securely and comfortably attached to the hair in the position the wearer prefers. FIG. 2-A shows a comb 61 to which is affixed a strip of the loop side of a hook-and-loop fastener 31. FIG. 2-B shows a barrette 52, to which is affixed a strip of the hook side of a hook-and-loop fastener 22. As in the previous embodiment, the size of the strips can vary, with the minimum size being that which allows the hook-and-loop fastener to perform its fastening function, but the size that provides most elegant appearance, and that allows the firmest hold, is a size that almost covers the top side of the barrette and the underside of the comb, excluding the teeth part of the comb. FIG. 2-C shows the comb in place in the hair, with a wave, or swirl, in the hair leading to the comb.

A third preferred embodiment is illustrated in FIGS. 3-A through 3-C. These figures illustrate the securing assembly which allows a hair cascade foundation to be securely and comfortably held in the hair, and which allows height in the hair. FIG. 3-A shows a hair cascade foundation 62. This foundation is a hollow circle of molded plastic or metal or foam, which can be decorated with any of the materials listed above as potential decorations for the molded headband 60. This foundation can be of various diameters, from 4 cm to 14 cm, and the walls of the foundation can be of various heights from 1 cm to 8 cm. The wall of the foundation can be thicker at the bottom than at the top. Also, the wall of the foundation can be higher in the back than in the front. The foundation can also be in the shape of an eclipse, rather than a perfect circle. These variations in the basic shape allow for different hooks, but the operation is the same in all cases. Affixed to the inside of the hair cascade foundation is a strip of the loop side of a hook-and-loop fastener 32. While the minimum size for this strip is a size that allows the hook-and-loop fastener to perform its fastening function, a strip which lines the entire inside of the hair cascade foundation provides the most elegant appearance, and allows the wearer to fine-tune placement of the foundation. FIG. 3-B shows a barrette 52 holding a specific amount of hair. The barrette is positioned some distance away from the roots of the hair. This distance can vary, according to the preference of the wearer. FIG. 3-C shows the hair held by the barrette, bent at a 90 degree angle, and secured to the inside of the hair cascade foundation by the mating of the strips of hook-and-loop fastener. The hair then cascades out over the foundation, in an elegant manner, giving height to the hair, without the use of gels or sprays or mousses, and without the use of backcombing or teasing the hair.

FIGS. 4-A through 4-E illustrate some of the various sizes of barrettes that are used to hold various amounts of hair comfortably and securely in the position on the head the wearer chooses. FIGS. 4-A through 4-C show side views of barrettes, while FIGS. 4-D and 4-E show top views. However, the barrettes could be longer, shorter, wider, or narrower, or they could be shaped differently, and they still could serve the function of holding a specific amount of hair comfortably and securely in the position the wearer chooses. The barrettes can be made of metal or plastic, or any other material that can repeatedly clasp and unclasp without fracturing. Reference numerals 80–85 show first and second components for engaging hair and clamping said hair therebetween, with reference numerals 80–82 showing first components and reference numerals 83–85 showing second components While the barrettes shown rely on the elasticity of the metal to allow the clasping function, barrettes of other designs, with other clasping mechanisms may also be used, as long as they serve the function of holding a specific amount of hair, comfortably and securely, in the position the wearer chooses. Each barrette has affixed to its top surface a strip of the hook side of a hook-and-loop fastener. While the strip can be of any size which allows the hook-and-loop fastener to perform its fastening function, the most elegant appearance and firmest hold is accomplished by a strip that almost covers the top surface of the barrette. Barrette 50 is a large barrette, 11 cm by ¾ cm. Strip 20 is affixed to barrette 50 by a permanent adhesive. Barrette 51 is a medium barrette, 9 cm by ⅝ cm. Strip 21 is affixed to barrette 51 by a permanent adhesive. Barrette 52 is a small barrette, 6 ½ cm by ½ cm. Strip 22 is affixed to barrette 52 by a permanent adhesive. Barrette 53 is an extra small barrette, 5 ½ cm by ½ cm. Strip 23 is affixed to barrette 53 by a permanent adhesive. Barrette 54 is a wider extra small barrette, 5 ½ cm by ⅞ cm. Strip 24 is affixed to barrette 54 by a permanent adhesive. Again, the sizes and shapes of barrettes in FIGS. 4-A through 4-E merely show a sampling of the sizes and shapes these barrettes can take, and other sizes and shapes can also serve the required function. For example, a barrette for a doll's hair could be considerably smaller than the smallest barrette shown here, or it could clasp in a different manner. While it is preferable to affix the hook side of a hook-and-loop fastener to the barrettes, the loop side could be affixed instead. Affixing the hook side to the barrette, and the loop side to the hair ornament or hair control device, keeps the hooks from engaging the hair, which can cause some tangling.

FIGS. 5 through 10 show additional embodiments of the invention. In each embodiment, a hair ornament or hair control device or other item to be secured to the hair will have a strip of the loop side of a hook-and-loop fastener affixed to it. In each case, the strip must be, at minimum, of a size that allows the hook-and-loop fastener to perform its fastening function.

In FIG. 5, elastic headband 63 has affixed to its underside a strip of the loop side of a hook-and-loop fastener 33. The optimum size for strip 33 is 8 cm long by 1 cm wide.

Figure 6:
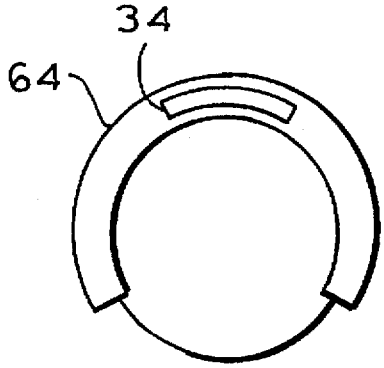
FIG. 6 shows a partially elastic headband.

In FIG. 6, partially elastic headband 64 has affixed to its under surface a strip of the loop side of a hook-and-loop fastener 34. The optimum size for this strip is 7 cm by 1 cm.

Figure 7:
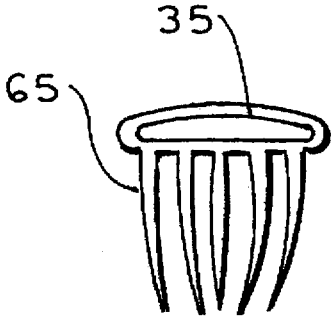
FIG. 7 shows a comb for a French twist hairstyle.

In FIG. 7, French twist comb 65 has affixed to its underside a strip of the loop side of a hook-and-loop fastener 35. The size of strip that provides the most elegant appearance and allows the firmest hold is a size that almost covers the underside of the comb, excluding the teeth part of the comb.

Figure 8:
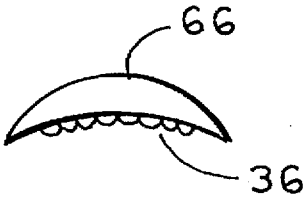
FIG. 8 shows a tiara-band-shape generic.

FIG. 8 shows a tiara-band-shape generic hair ornament 66. This ornament can be of different sizes and shapes, and can be made of any decorative material suitable for wear in the hair, including cotton, silk, linen, wool, leather, suede, man-made fabrics, gemstones, pearls, lacquered paper, beads, and seashells. The basic shape is gently curved where the ornament will meet the head. Generally, the center will be wider and the ends tapered. While this ornament can be worn by anyone, it is specifically designed for women with short hair, whose options for hair ornaments are limited. The underside of the ornament is lined with a strip of the loop side of a hook-and-loop fastener 36.

Figure 9:
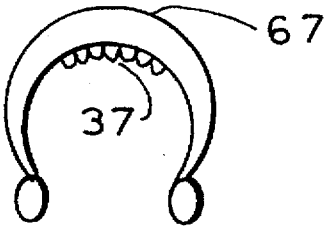
FIG. 9 shows a set of headphones.

FIG. 9 shows a pair of earphones 67, to the underside of which is affixed a strip of the loop side of a hook-and-loop fastener 37. The strip can be of any size that allows the hook-and-loop fastener to perform its fastening function.

Figure 10:
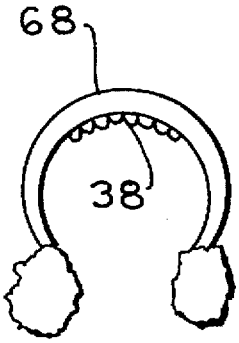
FIG. 10 shows a pair of earmuffs.

FIG. 10 shows a pair of earmuffs 68, to the underside of which is affixed a strip of the loop side of a hook-and-loop fastener. The strip can be of any size that allows the hook-and-loop fastener to perform its fastening function.

Figure 11:
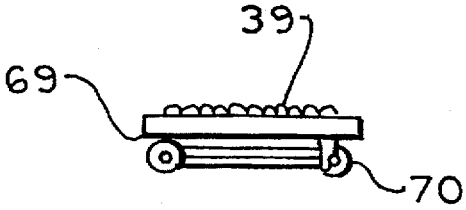
FIG. 11 shows a pin-backed finding.

FIG. 11 shows a pin-backed finding. Affixed to base 69 is a strip of the loop side of a hook-and-loop fastener 39. The strip can be any size that allows the hook-and-loop fastener to perform its fastening function. However, the most elegant appearance and firmest hold will be provided by a strip that almost covers the head of the finding. The finding can be of any size that fits on a person's head, but the optimum size is approximately 4 ½ cm long by ¾ cm wide.

Figure 12:
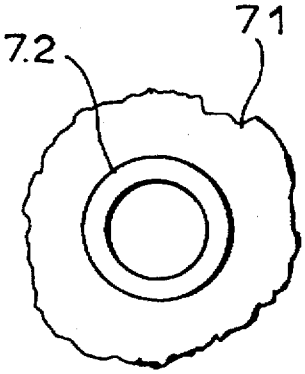
FIG. 12 shows a "scrunchie" hair ornament.

FIG. 12 shows a "scrunchie" type hair ornament, in which a donut-shaped piece of decorative fabric contains a circular strip of elastic 72.

A hook-and-loop fastener is necessary to the function, utility, and design of the present invention. Heretofore an alternative embodied product providing the unique results of a hook-and-loop fastener has not been found suitable. Options for future embodiment, should such a substance become available, are implied.

From the description above, a number of advantages of the present invention become evident:

a) Women, with varying lengths and thicknesses of hair, can wear hair ornaments and hair control devices in comfort.

b) A woman can put these hair ornaments and hair control devices in the hair and have them stay securely, even if she engages in vigorous activity.

c) A woman can choose where to position the hair ornament or hair control device so that it is flattering to her particular face shape.

d) A wearer can secure other items to the head, such as earphones and earmuffs, and have them stay in place comfortably and securely, even if the wearer engages in vigorous activity.

Operation

FIGS. 1-A through 1-E shows how a wearer can secure a molded headband 60 comfortably and securely to her hair. She chooses where she wants to position the headband on her head, and how much hair she wants to hold. She selects a barrette in a size that will hold that specific amount of hair securely. This could be barrette 50, 51, 52, 53, or 54, or any other size available. To the underside of the headband is affixed a strip of the loop side of a hook-and-loop fastener 30. To the top surface of the barrette is affixed a strip of the hook side of a hook-and-loop fastener 20, 21, 22, 23, 24, or a strip of any other size affixed to a barrette of any other size. The wearer then gently stretches the headband so that it will not be tight and uncomfortable on her head. She then sets the headband onto the barrette, and the hook-and-loop fastener forms a semipermanent attachment. She may choose to use more than one barrette.

The variety of sizes of barrettes, a sampling of which are shown in FIGS. 4-A through 4-E, allows the wearer to position the headband in different places on the head, thereby flattering face shape. For example, using a large barrette, the wearer can grasp a large amount of hair at the back of the top of the head, and place the headband there, giving the appearance of a longer face, as shown in FIG. 1-D. Alternatively, the wearer can use a small barrette to grasp a small amount of hair close to the forehead, and by placing the headband there, give the appearance of more roundness to a long thin face, as shown in FIG. 1-E.

The use of varying sizes of barrettes also allows for height, or "poofs", in the hair as shown in FIG. 1-C. To achieve this poof, a wearer must hold the hair securely, because if the barrette holds the hair loosely, the hair will simply flatten out. Since people have varying thicknesses of hair, the variably sized barrettes let each wearer choose the size of barrette that will hold the chosen amount of hair firmly, thereby insuring that the poof in the hair does not flatten out. The wearer can also choose to use more than one barrette to anchor the hair in a preferred position.

A wearer would follow a similar procedure to secure an elastic headband 63, FIG. 5, or a partially elastic headband 64, FIG. 6. She would not need to stretch the band, because these bands are already comfortable, because of their elasticity. However, only the use of the securing assembly of the present invention allows her to position the headband where she wants it on her head to flatter her face shape. Without the use of the present invention, the headband will automatically gravitate to the smallest part of her head.

Furthermore, the use of the present invention allows the wearer to form a "poof" of hair and hold it securely in the appropriately sized barrette. She then can set the headband on the barrette, and the strips of hook-and-loop fastener will form a semipermanent attachment. The "poof" adds height to the hair, and the appearance of length to the face. Without the use of the present invention, the wearer's hair will flatten out and not stay in a "poof" unless the band is excruciatingly tight.

A wearer would follow a similar procedure to wear earphones 67, FIG. 9, and earmuffs 68, FIG. 10. As above, the wearer may choose to use more than one barrette for a firmer hold. For example, a skater wearing earphones attached to a cassette player might choose to use two barrettes, each positioned just to the side of the center of the head.

A wearer would also follow a similar procedure to wear tiara-band 66, FIG. 8. The tiara-band allows a wearer, who does not wish to wear a full headband, to still wear an ornament on the head. It is especially nice for a wearer with short hair, on whom a full headband might look like overkill. It also allows a wearer to create a "poof" in the hair to give height, and to cover the barrette which holds the "poof" with a pleasing ornament. This ornament, depending on its size can also be worn on the side of the head, or on the back of the head.

FIGS. 2-A through 2-C show how a wearer can secure a comb 61 comfortably and securely to the hair. As with the other embodiments, described above, the wearer chooses a barrette to hold the desired amount of hair in the desired position on the head. Comb 61 is attached to barrette 52 by the mating of strips of hook-and-loop fastener B-1 and 22. As above, varying sizes of barrettes allow wearers who have varying thicknesses and lengths of hair to grasp firmly and hold in place a chosen amount of hair, to which the comb can be attached. For example, people with thin hair will choose a small barrette, as shown in FIG. 4-A, or a wider small barrette, as shown in FIG. 4-E, to hold hair comfortably and securely in the desired position. With the use of the present invention, the wearer can also create waves or swirls in the hair, which are held securely and comfortably in place by the appropriately sized barrette.

A wearer would follow the same procedure to secure the French twist comb shown in FIG. 7 to the hair.

The hair cascade foundation shown in FIGS. 2-A through 2-C uses the securing assembly of the present invention to allow a wearer to create height in her hair without the use of hairsprays or gels or mousses, and without backcombing or teasing the hair. The wearer chooses a barrette 52 to hold the specific amount of hair she wishes to have cascade down from a height on her head. She positions the barrette 1.5 cm or more back from the roots of her hair. She then pulls the hair through the center of the hair cascade foundation 62, and sets the foundation on her head. She then folds her hair at a right angle, and mates the loop side of a hook-and-loop fastener 32, which lines the inside of the hair cascade foundation, to the hook side of a hook-and-loop fastener 22 affixed to the barrette. More than one barrette can be used if the hair cascade foundation more than 3 cm high. The selected portion of the wearer's hair then cascades out over the hair cascade foundation, giving the appearance of height to the hair, securely and comfortably, and elegantly.

The pin-backed finding in FIG. 11 allows a wearer to secure other items she might own, such as scarves, to her hair. She would, for example, tie a knot or bow in the scarf, pierce the scarf with the pin 70, lock the pin shut, and then affix the scarf to the hair by mating the base 69, to which is affixed a strip of the loop side of a hook-and-loop fastener 39, to whichever size barrette she chooses to use, to which is affixed the hook side of a hook-and-loop fastener.

The "scrunchie" hair ornament shown in FIG. 12 can also be secured to the hair using the pin-backed finding shown in FIG. 11. Many women own lots of scrunchies. Scrunchies are designed to be worn by pulling hair through the hole in the center of the donut-shaped scrunchie 71 and twisting the elastic 72 into a figure-eight shape, and then pulling the hair through a second time, so that the hair is held in place. A wearer will use a scrunchie, for example, to hold a ponytail, because it is more attractive than using a plain rubber band to hold the ponytail. Using the pin-backed finding shown in FIG. 11, a wearer will have alternative way to wear her scrunchies. She can simply fold the scrunchie in half, and pierce it several times with pin 70, and lock the pin shut. Then the scrunchie can be placed anywhere on the wearer's head simply by mating the strip of the loop side of the hook-and-loop fastener on the pin-backed fastener head 39 and the hook side of a hook-and-loop fastener affixed to whichever size barrette the wearer chooses.

SUMMARY, RAMIFICATIONS, AND SCOPE

Although the description above contains many specificities, these should not be construed as limiting the scope of the invention but as merely providing illustrations of some of the presently preferred embodiments of this invention. For example, with the continued development of cellular-phone technology, and miniaturization of receiving devices, the mechanism of my invention may be used to securely and comfortably secure to the wearer's head a cellular phone, a pager, or a device whereby, for example, a coach can communicate instantly with a person practicing sports, or a director communicate with a single dancer in a chorus line.

Accordingly, the reader will see that the hair ornament and hair control device securing mechanism of this invention can be used to secure headbands, combs, hair cascade foundations, and other hair ornaments and hair control devices to the hair in a manner that is secure, comfortable, versatile, and flattering. Further, said securing mechanism of this invention can secure other items that are similar in shape to a headband, such as earphones and earmuffs, to the hair securely and comfortably.

Thus the scope of the invention should be determined by the appended claims and their legal equivalents, rather than by the examples given.

I claim:

1. A hair control device securing assembly comprising a barrette having an elongated flat top and an underside;

a clip pivotally affixed to said underside for holding an amount of hair in a specific position on a wearer's head;

an elongated hair control device having a central section and opposite ends which approach each other, thereby forming a substantially arcuate shape, such that the hair control device has a concave side and convex side to conform to a wearer's head;

a piece of releasable hook and loop material affixed to the central section of said hair control device on the concave side thereof and a mating piece of hook and loop material affixed to the flat top of said barrette;

wherein said barrette, holding an amount of hair, and said hair control device are fastened together by said releasable hook and loop material, the hair will be retained in place by said barrette and said hair control device.

2. The securing assembly of claim 1, wherein the hair control device is an earphone.

3. The securing assembly of claim 1, wherein the hair control device is an earmuff.

4. The securing assembly of claim 1, wherein the hair control device is a cellular phone.

5. The securing assembly of claim 1, wherein the hair control device is a hairband.

6. A hair control device securing assembly comprising:

a barrette having an elongated flat top and an underside;

a clip pivotally affixed to said underside of holding an amount of hair in a specific position on a wearer's head;

a hair cascade foundation having a ring for passing an amount of hair therethrough, and having a piece of releasable hook and loop material affixed on an inside surface of said ring, and a mating piece of releasable hook and loop material affixed to the flat top of said barrette;

wherein said barrette, holding an amount of hair, and said hair cascade foundation are fastened together by said releasable hook and loop material, the hair will be retained in place by said barrette and said hair cascade foundation.

* * * * *